United States Patent [19]

Lett, III

[11] 3,992,849

[45] Nov. 23, 1976

[54] METHOD OF INNER PACKAGING OF ARTICLES OF FURNITURE

[76] Inventor: Robert B. Lett, III, 1102 Greenway Drive, High Point, N.C. 27262

[22] Filed: Oct. 29, 1975

[21] Appl. No.: 626,840

Related U.S. Application Data

[62] Division of Ser. No. 412,616, Nov. 5, 1973, abandoned.

[52] U.S. Cl. ..... 53/27; 206/526

[51] Int. Cl.[2] ..... B65B 25/00; B65B 27/00

[58] Field of Search ..... 53/3, 27, 35, 37; 206/207, 320, 326, 521

[56] References Cited

UNITED STATES PATENTS

| | | | |
|---|---|---|---|
| 3,023,885 | 3/1962 | Kindseth | 206/521 X |
| 3,192,680 | 7/1965 | Mantell et al. | 53/27 |
| 3,403,778 | 10/1968 | Voytko et al. | 206/521 |
| 3,729,893 | 5/1973 | Bobb | 53/27 |

*Primary Examiner*—Robert Louis Spruill
*Attorney, Agent, or Firm*—Hugh C. Bennett, Jr.

[57] ABSTRACT

A method for packaging articles of furniture using an interlay sheet having standard peripheral dimensions corresponding to the inner dimensions of a standard size corrugated shipping container. The interlay sheet has bendable tabs which, in cooperation with a restraining band, spatially secures the sheet to articles of furniture having varying peripheral dimensions, which dimensions are at least smaller than the shipping container's inner dimensions. The interlay sheet spatially positions the article of furniture within the shipping container and may include a non-abrasive layer on the article-of-furniture contacting surface thereof.

2 Claims, 4 Drawing Figures

METHOD OF INNER PACKAGING OF ARTICLES OF FURNITURE

This is a division of application Ser. No. 412,616, filed Nov. 5, 1973, now abandoned.

BACKGROUND OF THE INVENTION

This invention relates to packaging units for articles of furniture and the like and more specifically to a means for spatially positioning said article of furniture within a shipping container for storage and/or shipment thereof. It is well known in the furniture industry, respecting the storage and/or shipment of articles of furniture, that the articles are packaged in outer containers and stacked for storage and/or shipping with the article of furniture itself serving as the load carrying structure for the stack and the outer container with its inner packings serving as a protective coating for said articles' finished surfaces. In packaging furniture, particularly for shipment, the packaged unit must comply with certain uniform freight requirements furnished by freight carriers to insure that the article of furniture is reasonably protected against in transit damage and other casualty. Furniture packaging specifications have been standardized, to a large degree, by railroad and motor freight carriers, whereby a minimum clearance between finished and upholstered surfaces of said articles of furniture and the interior surfaces of the shipping container must be maintained in order to reduce the occurrence of damage thereto. In addition, finished surfaces of furniture must be protected from contact with interior spacing and packaging forms by a non-abrasive material. Heretofore compliance with these requirements have required the use of a non-abrasive material, such as kraft paper having layers of tissue paper laminated to one side thereof, and spacing forms, such as the corner pad illustrated in U.S. Pat. No. 2,670,122, to accomplish the required purpose. Different types of spacing forms, pads and/or combinations thereof have been used in order to comply with said freight carrier's packaging specifications.

The aforesaid known devices and methods do function as intended; however, furniture manufacturers and dealers having a large variety of shapes and forms of furniture articles find it necessary to carry an extremely large inventory of different shapes and sizes of shipping containers, spacing forms, pads and other related materials to accommodate the different shapes and sizes of articles of furniture. For example, different size shipping containers would be required to accommodate a small bedside table, a larger end table, and a still larger writing table or the like. Such result, of course, increases the shipping and storage expense associated with goods of this type.

SUMMARY OF THE INVENTION

The present invention provides an improved packaging unit and method which reliably and securely spaces an article of furniture within a standard size corrugated shipping container, maintaining minimum desired clearances between said article and the interior surface of said container, which unit is of a relatively simple, durable and economical construction. The improved packaging unit and method therewith eliminates the previous practice in furniture packaging of varying the outer shipping container's dimensions to accommodate the different sizes and shapes of furniture articles that are to be packaged for storage and/or shipment and permits the use of a standard size outer shipping container with a standard size insert spacing form or interlay sheet, which is made possible by adapting the interlay sheet, itself, to accommodate the various sizes and shapes of furniture articles. The packaging unit includes an interlay sheet, which is a substantially rigid sheet of any suitable material and has provided around the periphery thereof pairs of opposed, bendable tabs. The tabs receive a restraining band that encircles the interlay sheet and the article of furniture to be packaged therewith and securely holds said interlay sheet in spatial configuration with the article of furniture. The peripheral dimensions, being the lineal demensions along the outer edges thereof, of the interlay sheet exceed the corresponding dimensions of the article of furniture by an amount at least equal to the minimum required clearance between finished and upholstered surfaces of the article of furniture and the interior surfaces of the shipping container in which the article is to be packaged. The interlay sheet's peripheral dimensions, however, correspond to the inner dimensions of the shipping container to provide a snug fit therein. Articles of furniture having different dimensions may be suitably packaged using one standard size shipping container and interlay sheet, thereby reducing the expense and inconvenience of providing a large selection of shipping containers and packaging forms.

In a preferred embodiment of the invention an interlay sheet fabricated of laminated layers of corrugated cardboard, having alternate layers of corrugation at right angles is provided with an non-abrasive material on the furniture contacting surface thereof and positioned over an article of furniture to be packaged for shipping and storage. Laminated layers of corrugated paperboard, cardboard or the like is the preferred material for construction of the interlay sheet as disclosed herein; however, other materials are not to be excluded. A restraining band encircles both the interlay sheet and the article of furniture, overlying a pair of opposed bendable tabs and is tightened to depress said tabs and securely fasten the interlay sheet in spatial relationship with said article of furniture. Additional restraining bands may be used as needed to prevent shifting of said article of furniture relative to said interlay sheet.

DESCRIPTION OF THE DRAWING

The foregoing and other features and advantages of the invention will be in part evident and in part pointed out hereinafter in the following description of an illustrative embodiment thereof, which should be read in conjunction with the accompanying drawings, in which.

DESCRIPTION OF THE PREFERRED EMBODIMENT

Figure 1:
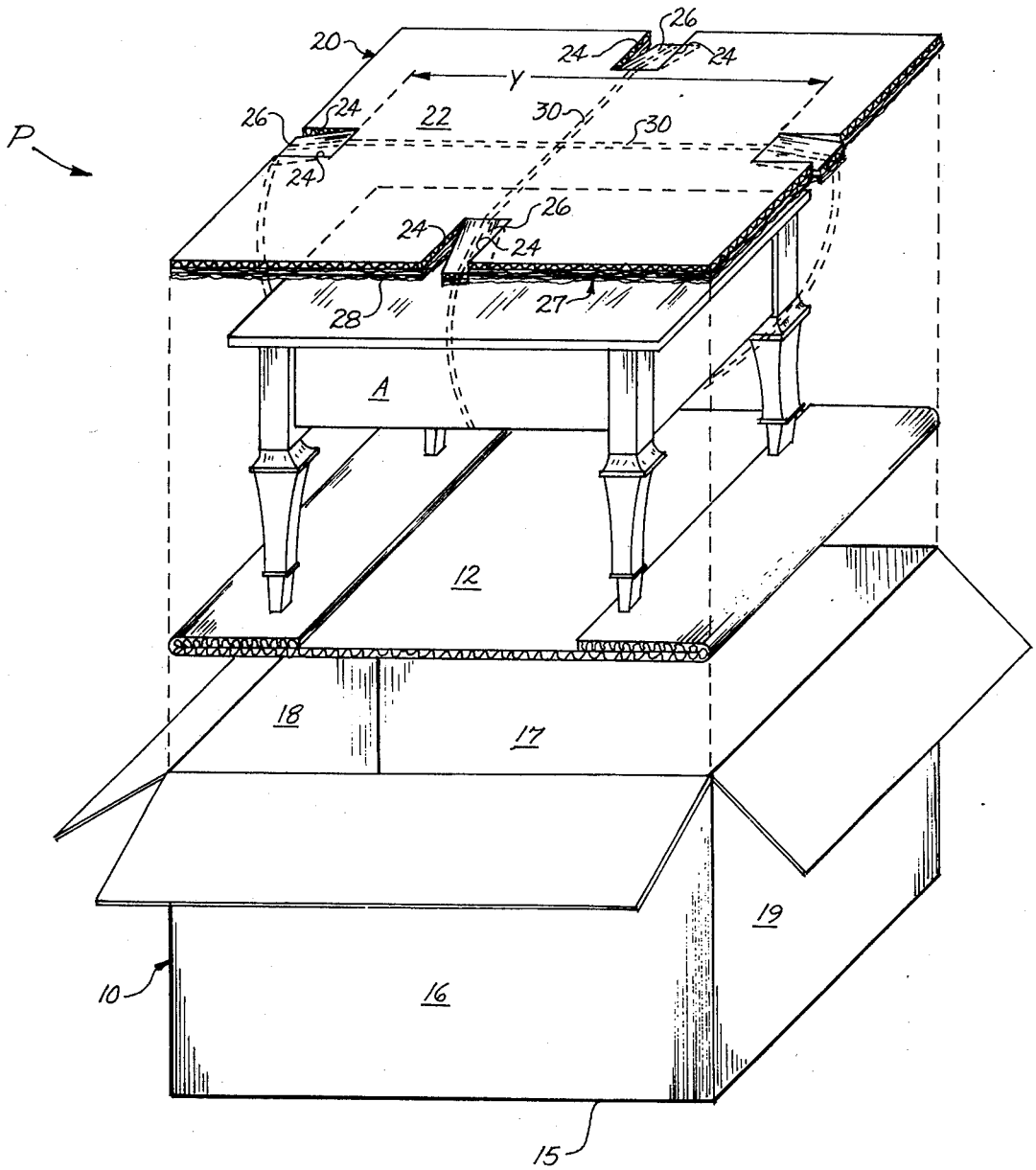
FIG. 1 is an exploded, perspective view of a packaging unit embodying the present invention, illustrating an article of furniture as it is packaged therewith.

The apparatus of FIG. 1 generally comprises a packaging unit P, including an outer container 10, a pallet insert 12 and an inner packaging assembly 20, all forming a package enclosure for an article of furniture, whereby said article is protected during storage and/or shipment. A standard corrugated paperboard shipping container is contemplated for use as the outer container 10 in connection with the embodiment described herein; however, other types of outer shipping containers may be used. While it is recognized that corrugated paperboard containers are provided, having different construction characteristics producing containers of different strength, the selection of such characteristics as specific outer container constructions would not be directly effected in practice of the present invention. The consideration regarding outer container selection that would be effected is that a furniture shipper would be able to utilize one standard outer container size to accommodate articles of furniture having different overall dimensions and avoid the previous problems associated with having to provide individual outer containers with dimensions especially adapted to fit each article of furniture to be packaged therein. Accordingly, the outer shipping container intended for use with the embodiment described herein is the conventional corrugated paperboard cubicle or rectangular type having a top 14, bottom 15, front 16, rear 17 and side walls 18, 19.

Turning now to FIG. 1, an article of furniture comprising an end table A, is prepared for storage and/or shipping in a packaging unit that is intended to satisfy furniture packaging specifications as established by the Uniform Freight requirements furnished by the freight carriers. A conventional pallet insert 12 may be used to provide the desired clearance from the lower extremes of the table A and the outer container's bottom 15, dimension X, FIG. 2. A piece of corrugated paperboard having two side portions thereof doubled back upon itself to provide the desired thickness forms the pallet 12 and is well known in the packaging industry.

Figure 2:
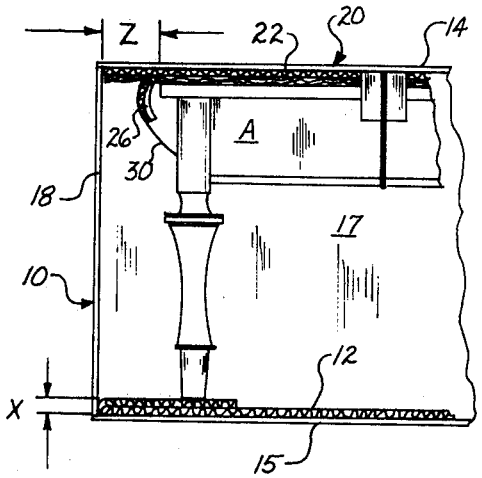
FIG. 2 is am assembled front view, in part, of the packaging unit of FIG. 1, with parts of the outer container cut away.
Figure 3:
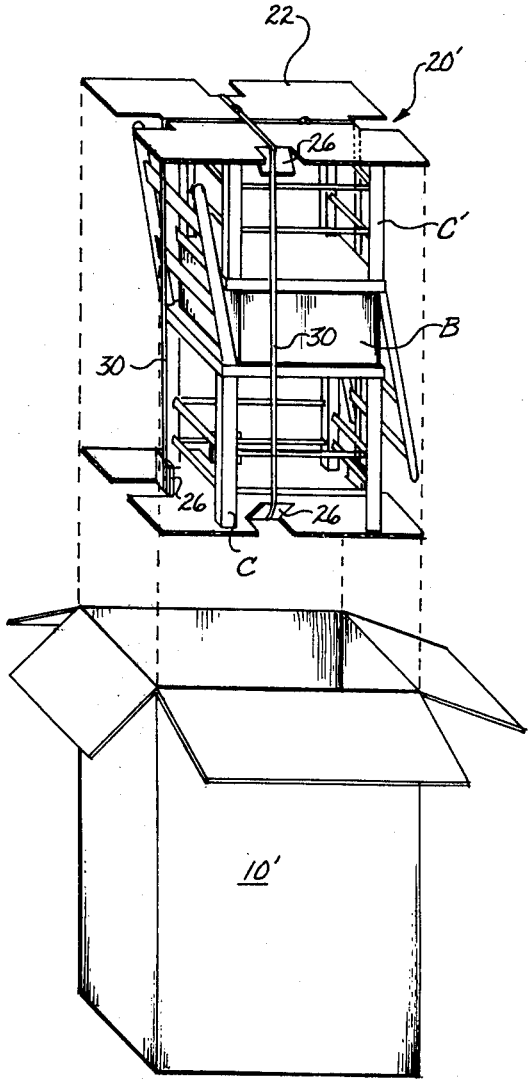
FIG. 3 illustrates in an exploded, perspective view, a packaging unit embodying the present invention in which two chairs are packaged for storage and/or shipment.

The article of furniture to be prepared for packaging and/or for storing is first made up into an inner packaging assembly 20, by attaching a substantially rigid interlay sheet 22 in load bearing contact, FIG. 2, thereto with a restraining means such as a plastic band 30.

Figure 4:
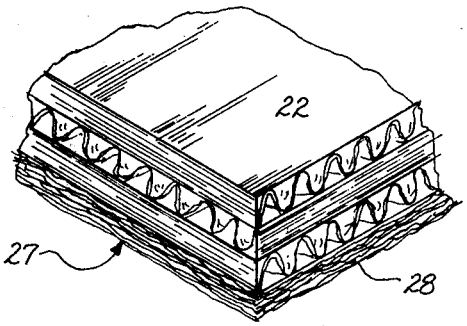
FIG. 4 is an enlarged view of one corner of the interlay sheet, comprising part of the packaging unit of FIG. 1.

The rigid interlay sheet 22 includes laminated board, FIG. 4, made up in any suitable combination of layers of corrugated board, pasteboard, paperboard, kraft paper and the like to produce a sheet having the desired thickness and strength characteristics. The foregoing materials are to be regarded merely as illustrative and not as limiting the scope hereof. Any type of rigid-bendable material can be used, as will be obvious to those experienced in the field. The furniture contacting surface 27 of said interlay sheet 22 may have laminated thereto a sheet of non-abrasive material 28 to provide a protective surface thereon. In the example, sheets of tissue paper are laminated to a sheet of kraft paper which is in turn laminated to the interlay sheet so that the tissue paper is exposed to form the non-abrasive surface which contacts said article of furniture A.

The inner package assembly 20 is formed by fixedly positioning the interlay sheet 22 relative to said article of furniture A, which positioning is accomplished by means of bendable tabs 26 and a restraining means.

The tabs 26 are positioned peripherally around said interlay sheet 22 in opposed pairs. Inwardly extending slits 24 are cut to form said bendable tabs 26 and extend inwardly from the outer edge of the sheet 22 a distance such that the transverse dimension (dimension *y*, FIG. 1), between opposed pairs of said tabs 26 will accommodate a corresponding dimension of the smallest article of furniture to be assembled therewith for the purpose of forming an inner packaging assembly. The slits 24 are spaced apart a sufficient distance to form tab 26 having a width that will accommodate the plastic band 30, but are sufficiently close so as to weaken the portion of interlay sheet 22 therebetween and forming the tab member 26 and permit said tab to bend upon application of pressure thereto.

A restraining means such as the plastic band 30 is wrapped around the interlay sheet 22, overlying a pair of opposed tabs 26 and encircling the article of furniture that is to be fixedly positioned therewith. Upon tightening and securing the band 30, the opposed tabs are flexed downwardly and rigidly position said interlay sheet 22 relative to said article of furniture. A second band 30 positioned normal to the first securely and fixedly positions said interlay sheet 22 relative to said article of furniture.

It will be noticed in FIG. 2, the interlay sheet projects laterally beyond the article of furniture by a dimension *z*, which dimension is adapted to provide the minimum desired clearance between the lateralmost extending extremes of said article of furniture and the side walls of said outer container 10. The interlay sheet 22 having standard lateral dimensions will fit into an outer container having corresponding standard dimensions; however, articles of furniture having varying dimensions can be made up and securely packaged therein by merely tightening the band 30 to fixedly attach the interlay sheet thereto. The thickness of the insert sheet 12 may be increased to accommodate the vertical dimensions of the article of furniture.

Most articles of furniture having a substantially planar horizontal surface are assembled into an inner packaging assembly by positioning the interlay sheet 22 on the top thereof; however, in the case of articles having odd sizes, such as chairs that are packaged in groupings, the interlay sheet can be used as illustrated in FIG. 4. Two chairs C, C′ are inverted seat-to-seat with a spacer block B sandwiched therebetween, thereby preventing the backrest of one chair from extending beyond the feet of the other, and otherwise protecting the chairs in packaging position. An interlay sheet 22 is positioned upon the upturned feet of one chair C′, while a second interlay sheet is positioned beneath the supporting feet of the second chair C. Bands 30 are wrapped therearound in overlying registry with pairs of opposed tabs 26 on each of said sheets 22 to secure the assembly into an inner pack assembly 20′. When the interlay assembly is inserted into the outer container 10′, the outer portions of the interlay sheets will provide the horizontal spacing between the lateral extremes of the chairs and the outer walls of the box, while the thickness of said sheets will provide the vertical spacing between said chairs' lower and upper extremes and the top and bottom of said outer container.

While a preferred embodiment of the invention has been specifically shown and described, it will be appreciated that this was for the purpose of illustration only, and not for purposes of limitation, the scope of the invention being in accordance with the following claims.

I claim:

1. A method for inner packaging articles of furniture, such as tables, chairs and the like, of varying shapes and sizes, in an outer container having a standard size relative thereto, said outer container being of the type having top, bottom, front, rear and side walls, said inner packaging method comprising the steps of:

a. providing a substantially rigid interlay sheet having length and width dimensions greater than the horizontal dimensions of said article of furniture to establish minimum predetermined clearance between the sides of said article of furniture and the corresponding side walls of said outer container, a thickness dimension to establish minimum predetermined clearance between the upper surface of said article of furniture and the corresponding wall of said outer container, which length and width dimensions substantially coincide with the horizontal, inner cross sectional dimensions of said outer container to provide a snug fit therebetween, and positioning said substantially rigid interlay sheet in load bearing contact with the upper surface of said article of furniture;

b. aligning said interlay sheet atop said article of furniture and substantially coaxially therewith, with the edges of said interlay sheet extending beyond the sides of said article of furniture;

c. providing a plurality of inwardly extending parallel slits in the periphery of said interlay sheet, forming pairs of opposed, bendable tabs therearound, said opposed tabs having a dimension therebetween substantially equal to or smaller than the corresponding dimension of said article of furniture, and encircling said article of furniture and said interlay sheet with a first adjustable band overlaying a pair of said opposed tabs and a second adjustable band overlaying another pair of said opposed tabs, which second band is positioned normal to said first band;

d. tightening said adjustable bands and depressing said pairs of opposed, bendable tabs into conforming relationship with the dimensions of said upper surfaces of said article of furniture to securely position said interlay sheet in load bearing contact with the upper surface of said article of furniture and spatially therewith to form a banded package component;

e. providing said outer container with a pallet therein having a thickness to establish minimum predetermined clearance between the bottom of said article of furniture and the corresponding wall of said outer container and to maintain load bearing contact between said interlay sheet and said top wall of said outer container; and f. inserting and enclosing said banded package component in said outer container while maintaining said article of furniture spatially in said outer container in load bearing contact with the top and bottom walls thereof and with minimum predetermined clearances maintained between the outer surfaces thereof and the corresponding walls of said outer container.

2. The method of claim 1, wherein said pallet provided therein is a substantially rigid insert sheet and said adjustable bands encircle both of said insert sheets and said article of furniture.

* * * * *